US007746287B2

(12) United States Patent
Noro

(10) Patent No.: US 7,746,287 B2
(45) **Date of Patent: *Jun. 29, 2010**

(54) ANTENNA APPARATUS INCLUDING A SHIELD COVER WHICH COVERS AN AMPLIFICATION CIRCUIT, THE SHIELD COVER HAVING AN APERTURE POSITIONED TO ALLOW OBSERVATION OF AN INPUT UNIT OF THE AMPLIFICATION CIRCUIT FROM OUTSIDE OF THE SHIELD COVER

(75) Inventor: Junichi Noro, Akita (JP)

(73) Assignee: Mitsumi Electric Co., Ltd., Tama-shi (JP)

( * ) Notice: Subject to any disclaimer, the term of this patent is extended or adjusted under 35 U.S.C. 154(b) by 358 days.

This patent is subject to a terminal disclaimer.

(21) Appl. No.: 11/895,099

(22) Filed: Aug. 23, 2007

(65) Prior Publication Data

US 2008/0068278 A1 Mar. 20, 2008

(30) Foreign Application Priority Data

Sep. 19, 2006 (JP) ..... 2006-252292

(51) Int. Cl.
*H01Q 1/52* (2006.01)

(52) U.S. Cl. ..... 343/841

(58) Field of Classification Search ..... 343/711, 343/712, 713, 841, 700 MS
See application file for complete search history.

(56) References Cited

U.S. PATENT DOCUMENTS

| | | | | |
|---|---|---|---|---|
| 5,585,806 | A * | 12/1996 | Ogino et al. | 343/700 MS |
| 5,831,577 | A | 11/1998 | Nichols et al. | |
| 6,538,611 | B2 | 3/2003 | Noro | |
| 6,674,013 | B2 | 1/2004 | Noro et al. | |
| 6,879,294 | B2 | 4/2005 | Yuanzhu | |
| 7,327,328 | B2 | 2/2008 | Yoneya et al. | |
| 2008/0068279 | A1 | 3/2008 | Noro | |

FOREIGN PATENT DOCUMENTS

| | | | |
|---|---|---|---|
| JP | 2004-72320 | A | 3/2004 |
| JP | 2004-228357 | A | 8/2004 |
| JP | 2005-110007 | A | 4/2005 |

* cited by examiner

*Primary Examiner*—Hoang V Nguyen
*Assistant Examiner*—Robert Karacsony
(74) *Attorney, Agent, or Firm*—Frishauf, Holtz, Goodman & Chick, P.C.

(57) ABSTRACT

Disclosed is an antenna apparatus that includes: an antenna element including a receiving unit to receive a radio wave; a circuit board on which an amplifier circuit to amplify an input signal sent from the antenna element is formed; an input pin to connect the receiving unit with the amplifier circuit; and a shield cover to cover the amplifier circuit on the circuit board, the shield cover shielding the amplifier circuit from a disturbing wave, wherein the input pin penetrates through the circuit board and is connected to the amplifier circuit by soldering, so as to structure an input unit of the circuit, and an ascertainment aperture is provided in the shield cover, the ascertainment aperture positioned such that the input unit can be observed from outside of the shield cover.

5 Claims, 4 Drawing Sheets

ANTENNA APPARATUS INCLUDING A SHIELD COVER WHICH COVERS AN AMPLIFICATION CIRCUIT, THE SHIELD COVER HAVING AN APERTURE POSITIONED TO ALLOW OBSERVATION OF AN INPUT UNIT OF THE AMPLIFICATION CIRCUIT FROM OUTSIDE OF THE SHIELD COVER

BACKGROUND OF THE INVENTION

1. Field of the Invention

The present invention relates to an antenna apparatus, and more particularly to an antenna apparatus which is used for receiving radio waves of a global positioning system (GPS), a satellite radio, and the like.

2. Description of the Related Art

Various antenna apparatuses have been developed as antenna apparatus which is used as, for example, an antenna apparatus of an in-car GPS system, which is wide-spread as a positioning system, an in-car antenna apparatus or an in-home fixed type antenna apparatus for a satellite radio, which has been put to practical use in the United States of America, and the like (see, for example, Japanese Patent Application Laid-Open Publication Nos. 2005-110007, 2004-72320, 2004-228357, and the like).

With respect to these antenna apparatuses, such as an antenna apparatus 100 illustrated in FIG. 6 for example, a circuit board 103 is attached on the back surface of an antenna element 102 including a patch type receiving surface 101 which receives radio waves. An amplifier circuit not shown, which amplifies a signal input from the antenna element 102, is formed on the surface of the circuit board 103 on the opposite side with respect to the antenna element 102 side, and the surface on which the amplifier circuit is formed is covered by a substantially box-like shield cover 104 which shields the amplifier circuit from external disturbing waves. Here, in FIG. 6, the receiving surface 101 is shown thicker than the actual thickness thereof.

An input pin 105 is provided to penetrate both the antenna element 102 and the circuit board 103 in a direction perpendicular to thereof, and one end side of the input pin 105 is electrically connected to the receiving surface 101 of the antenna element 102 by soldering. Moreover, the other end side of the input pin 105 is electrically connected to the amplifier circuit on the circuit board 103 by being soldered to the amplifier circuit, so that an input unit 103*a* is formed. The input pin 105 inputs a radio wave signal, which is received by the receiving surface 101 of the antenna element 102, to the amplifier circuit on the circuit board 103.

Moreover, a coaxial cable 106 is inserted into the inner side of the shield cover 104. A core wire 106*a* of the coaxial cable 106 is electrically connected to the amplifier circuit on the circuit board 103 by being soldered thereto, and the connecting portion constitutes an output unit 103*b* of the amplifier circuit. The coaxial cable 106 supplies driving power to the amplifier circuit through the core wire 106*a*, and outputs a signal that has been received by the antenna element 102 and has been amplified by the amplifier circuit.

Moreover, the shield cover 104 also serves as the ground (GND), where a tongue flap 104*b*, which is formed by being bent from the base surface 104*a* of the shield cover 104 to the side of the coaxial cable 106, is electrically connected to the outer conductor 106*b* of the coaxial cable 106 by being soldered thereto, thus allowing the shield cover 104 to be set to the GND potential through the tongue flap 104*b*. The amplifier circuit is grounded through the shield cover 104.

With respect to such antenna apparatus 100, as shown in FIG. 7 which shows the antenna apparatus 100 being turned upside down, in a case where the shield cover 104 is fixed in the state where the shield cover 104 covers the amplifier circuit, it becomes impossible to ascertain the existence and the quality of the soldering, the soldering using solder H and being soldered onto the amplifier circuit on the circuit board 103. This can be said especially for the soldering at a portion between the input pin 105 and the wiring of the circuit at the input unit 103*a* of the circuit as shown in FIG. 6.

However, in a case where the shield cover 104, which has been attached once, is removed in order to ascertain the soldering of the input pin 105, the operations of removing, ascertainment of the soldering, attachment and fixing of the shield cover 104, and the like, must be performed, and thus redundant processes increase in the manufacturing process of the antenna apparatus 100 and the operation becomes troublesome. Moreover, the repetition of the removal and the attachment lowers accuracy of the attachment of the shield cover 104 to the circuit board 103.

Moreover, even in a case where the soldering at the input unit 103*a* is not performed, signals are transmitted if the input pin 105 touches the wiring. In a case where the physical contact between the input pin 105 and the wiring is lost by changes within time, no signal is transmitted, and thus the antenna apparatus 100 no longer functions as the antenna. In a case where a user accordingly tries to ascertain the soldering of the input unit of the antenna that is out of order, the ascertainment cannot be performed unless the shield cover 104 is removed.

SUMMARY OF THE INVENTION

The present invention was made concerning the above-mentioned circumstances, and an object is to provide an antenna apparatus capable of ascertaining the existence and the quality of the soldering in an input unit of a circuit even after the shield cover is attached to the circuit board.

According to a first aspect of the present invention, there is provided an antenna apparatus, comprising:

an antenna element including a receiving unit to receive a radio wave;

a circuit board on which an amplifier circuit to amplify an input signal sent from the antenna element is formed;

an input pin to connect the receiving unit with the amplifier circuit; and a shield cover to cover the amplifier circuit on the circuit board, the shield cover shielding the amplifier circuit from a disturbing wave, wherein the input pin penetrates through the circuit board and is connected to the amplifier circuit by soldering, so as to structure an input unit of the circuit, and an ascertainment aperture is provided in the shield cover, the ascertainment aperture positioned such that the input unit can be observed from outside of the shield cover.

BRIEF DESCRIPTION OF THE DRAWINGS

The above and further objects, features and advantages of the present invention will become more apparent from the following detailed description taken in conjunction with the accompanying drawings, wherein.

DETAILED DESCRIPTION OF THE PREFERRED EMBODIMENTS

In the following, the preferred embodiments of an antenna apparatus according to the present invention will be described with reference to the attached drawings.

First Embodiment

Figure 1:
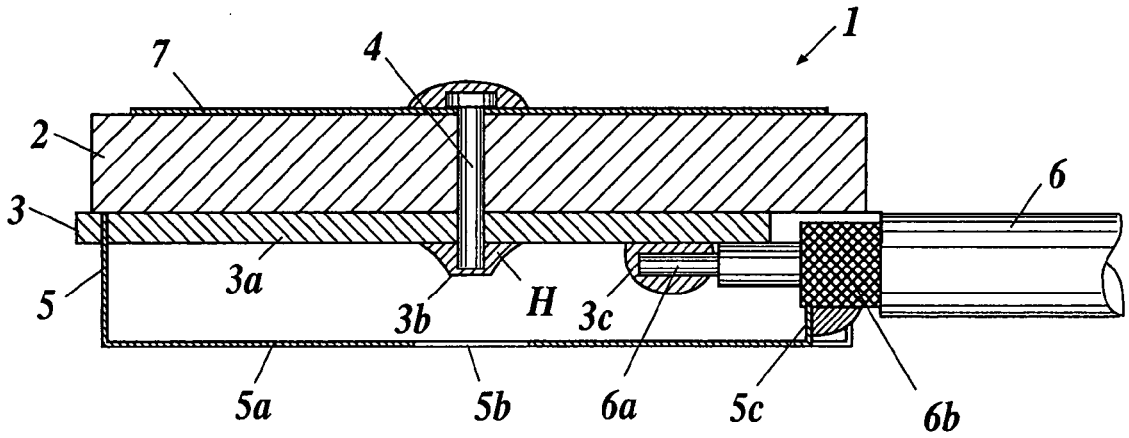
FIG. 1 is a schematic sectional view showing the configuration of an antenna apparatus according to a first embodiment.

An antenna apparatus 1 according to a first embodiment includes an antenna element 2, a circuit board 3, an input pin 4, a shield cover 5, a coaxial cable 6, and the like, as shown in FIG. 1.

In the present embodiment, the antenna element 2 is made of a ceramic and is formed as a plate that is slightly thick. A patch type receiving surface 7 as a receiving unit to receive radio waves is attached on one side of a surface of the antenna element 2. Here, the receiving surface 7 is drawn thicker than the actual thickness thereof in FIG. 1 and FIG. 3, which will be described later. Moreover, a not-shown GND pattern 9 of a metallic thin film is attached on substantially the whole surface of the antenna element 2 except for a portion of the input pin 4 and the circumjacent thereof, the surface being opposite to the receiving surface 7.

The circuit board 3 is provided on the opposite surface of the antenna element 2 with respect to the receiving surface 7 thereof. A not-shown GND pattern of a metallic thin film, other than the GND pattern of the antenna element 2, is attached on substantially the whole surface of the circuit board 3 except for a portion of the input pin 4 and the circumjacent thereof, the surface being the side of the antenna element 2.

In the present embodiment, the GND pattern of the circuit board 3 and the GND pattern of the antenna element 2 are attached together with an adhesive member, such as a double-coated adhesive tape, and the antenna element 2 and the circuit board 3 are thereby bonded together. Moreover, the GND pattern of the circuit board 3 functions as the GND pattern of the antenna element 2 together with the GND pattern of the antenna element 2 itself.

A not shown circuit that amplifies an input from the antenna element 2 and outputs the amplified input is formed on the surface of the circuit board 3 which is the opposite side to the antenna element 2, i.e., on a circuit surface 3*a*. A not-shown plurality of through-holes are formed in the circuit board 3 at suitable positions, and the ground of the circuit on the circuit surface 3*a* is connected to the GND pattern on the back surface of the circuit board 3 through the through-holes.

The input pin 4 is provided so as to penetrate through the receiving surface 7 of the antenna element 2 and the circuit surface 3*a* of the circuit board 3 in a perpendicular direction with respect to the surfaces, at a predetermined position of the antenna element 2 and the circuit board 3. In the present embodiment, one end side of the input pin 4 is electrically connected to the receiving surface 7 of the antenna element 2 by soldering.

Moreover, the other end side of the input pin 4 is electrically connected to the amplifier circuit on the circuit board 3 by soldering using solder H, and the connection portion structures an input unit 3*b* of the circuit. The input pin 4 inputs a radio wave signal received by the receiving surface 7 of the antenna element 2 to the amplifier circuit of the circuit board 3 through the input unit 3*b*.

The shield cover 5, which is made of metal and is formed as substantially a box-shape, is attached to the circuit board 3 on the side of the circuit surface 3*a* so as to cover the circuit surface 3*a*, and the shield cover 5 shields the circuit surface 3*a* from disturbing waves that arrive at the circuit surface 3*a* from the outside. Moreover, a base surface 5*a* of the substantially box-shaped shield cover 5 is arranged in parallel with the receiving surface 7 of the antenna element 2 and the circuit surface 3*a* of the circuit board 3.

Figure 2:
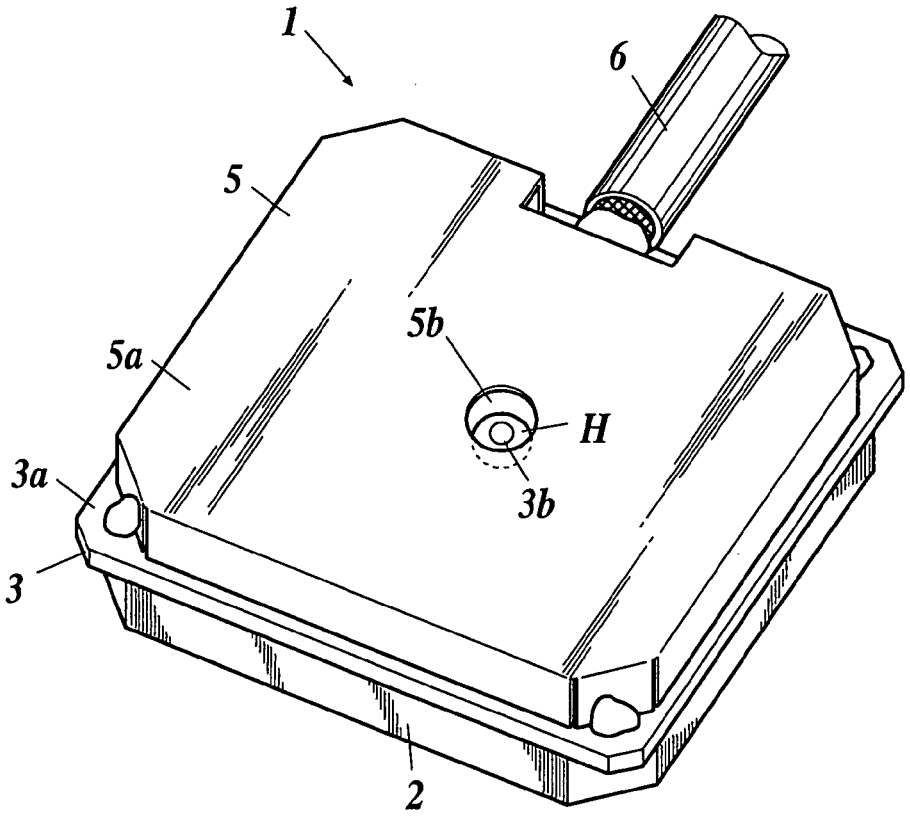
FIG. 2 is a perspective view showing a shield cover, a coaxial cable, and the like, the antenna apparatus of FIG. 1 being turned upside down.

As shown in the sectional view of FIG. 1, a part of the shield cover 5 is formed so as to project and to penetrate through the circuit board 3, thereby location of the shield cover 5 is affirmed with respect to the circuit board 3. Moreover, as shown in FIG. 2, in the present embodiment, the shield cover 5 is electrically connected to the ground of the circuit by being soldered to the ground on the circuit surface 3*a* of the circuit board 3. Here, in FIG. 2 and FIG. 4 which will be described later, the antenna apparatus 1 is shown in the state in which the antenna apparatus 1 is turned upside down.

An ascertainment aperture 5*b* is formed at the base surface 5*a* of the shield cover 5, in a position where the input unit 3*b* on the circuit board 3 can be seen from the outside. In the present embodiment, the ascertainment aperture 5*b* is formed as a circle at a position on the shield cover 5, which position is opposed to the input unit 3*b*. Here, the shape of the ascertainment aperture 5*b* is not limited to circle, and the ascertainment aperture 5*b* may be formed as a triangle, a rectangle, and the like, as long as the input unit 3*b* can be seen from the ascertainment aperture 5*b*.

Into the inner part of the shield cover 5, the coaxial cable 6 is inserted as shown in FIG. 1. The core wire 6*a* of the coaxial cable 6 is electrically connected to the amplifier circuit on the circuit board 3 by soldering, and the connection portion structures an output unit 3*c* of the circuit. The coaxial cable 6 supplies driving power to the amplifier circuit through the core wire 6*a*, and outputs a signal that is received by the antenna element 2 and is amplified by the amplifier circuit, through the output unit 3*c* to the downstream side.

Moreover, a tongue flap 5*c* is formed on the shield cover 5 so as to be bent from the base surface 5*a* of the shield cover 5 and extend to the coaxial cable 6. The tongue flap 5*c* and the outer conductor 6*b* of the coaxial cable 6 are soldered together to be electrically connected with each other.

GND potential is supplied to the outer conductor 6*b* of the coaxial cable 6, and by the connection of the outer conductor 6*b* with the tongue flap 5*c*, the GND potential is supplied from the outer conductor 6*b* of the coaxial cable 6 to the amplifier circuit of the circuit board 3 through the tongue flap 5*c* and the shield cover 5.

Next, the operation of the antenna apparatus 1 according to the present embodiment is described.

Driving power is supplied from the core wire 6*a* of the coaxial cable 6 to the amplifier circuit on the circuit board 3 of the antenna apparatus 1 through the output unit 3*c*. Moreover, when the receiving surface 7 of the antenna element 2 receives a high frequency radio wave for the GPS or a satellite radio, the radio wave signal is transmitted to the amplifier circuit through the input unit 3*b*, and a radio wave signal amplified by the amplifier circuit is output from the output unit 3*c* through the core wire 6*a* of the coaxial cable 6.

The amplifier circuit of the circuit board 3 is shielded from disturbing waves from the outside by the shield cover 5 which is made of a metal and covers the amplifier circuit. Moreover, the ground of the amplifier circuit is connected to the shield cover 5, as described above, and the amplifier circuit is grounded by receiving the supply of the GND potential from the outer conductor 6*b* of the coaxial cable 6 to the shield cover 5. The GND potential is also supplied to the GND pattern of the circuit board 3 through the through-holes of the circuit board 3, and the GND pattern of the circuit board 3 is grounded to supply the GND level to the antenna element 2.

On the other hand, the soldering portion of the input pin 4 and the wiring of the circuit in the input unit 3*b* on the circuit board 3 is observed through the ascertainment aperture 5*b* formed in the shield cover 5 of the antenna apparatus 1. Consequently, it is possible to ascertain whether the solder H for soldering exists in the input unit 3*b* or not, i.e. whether soldering is performed or not, or whether the soldering is certainly performed or not, by visual observation.

As described above, in the antenna apparatus 1 according to the present embodiment, by providing the ascertainment aperture 5*b* in the shield cover 5 that covers the surface of the circuit board 3 on which surface the circuit is formed, easy and certain ascertainment of the existence of the solder H in the input unit 3*b* of the circuit and of the quality of the soldering can be conducted by visual observation through the ascertainment aperture 5*b* even after attaching the shield cover 5 to the circuit board 3.

If the antenna apparatus 1 is configured as above, then a manufacturing worker visually observes the soldering portion of the input pin 4 and the wiring of the circuit in the input unit 3*b* on the circuit board 3 through the ascertainment aperture 5*b* formed on the base surface 5*a* of the shield cover 5 without removing the shield cover 5 at the manufacturing time of the antenna apparatus 1, and can easily and certainly ascertain the existence of the solder H and the quality of soldering in the input unit 3*b*.

Consequently, there is no necessity of removing the shield cover 5 to ascertain soldering, re-attach the shield cover 5, and the like, and thus manufacturing process is simplified and deterioration of the attachment accuracy of the shield cover 5 by the removal and the re-attachment is prevented.

Moreover, in a case where the antenna apparatus 1 undergoes breakdown during operation, a user can ascertain the existence of the solder H and the quality of soldering in the input unit 3*b* by visual observation through the ascertainment aperture 5*b* without removing the shield cover 5, in a similar manner. Consequently, the user can be prevented from judging that the cause of the breakdown of the antenna apparatus 1 is the failure of soldering in the input unit 3*b* and from removing the shielding cover 5 from the circuit board 3, although the soldering in the input unit 3 is pertinently performed in actual.

Furthermore, as the present embodiment, in a case where the ascertainment aperture 5*b* is formed at the position of the shield cover 5, the position opposing the input unit 3*b*, it becomes possible to more easily and certainly ascertain the existence of the solder H and the quality of the soldering in the input unit 3*b* by visual observation through the ascertainment aperture 5*b*.

Incidentally, in a case where the ascertainment aperture 5*b* in the shield cover 5 lowers the shielding efficiency of the shield cover 5 from disturbing waves, it is also possible to obstruct the ascertainment aperture 5*b* of the shield cover 5 by covering the ascertainment aperture 5*b* with a metallic tape such as a copper tape as an electroconductive member, which is detachable to the shield cover 5.

By such configuration, it becomes possible to prevent the lowering of the shielding efficiency of the shield cover 5 from disturbing waves, which is caused by providing the ascertainment aperture 5*b*, and the shielding efficiency can be maintained.

Moreover, in the antenna apparatus of the present embodiment, in a case where the apparatus is miniaturized, the input unit 3*b* and the output unit 3*c* of the amplifier circuit on the circuit board 3 come close to each other, and thus isolation between inputs and outputs of signals deteriorate and may cause leakage of signals between the input unit 3*b* and the output unit 3*c*. Leakage of signals are caused in the air or in the circuit board between the input unit 3*b* and the output unit 3*c*, and a part of a signal which is to be output from the output unit 3*c* leaks to the input unit 3*b* due to the leakage of signals. Thus, positive feedback is produced in the circuit, and in the worst case, a standing wave is generated in the amplifier circuit to generate an abnormal oscillation phenomenon to strengthen the signal strength of a specific frequency.

Figure 3:
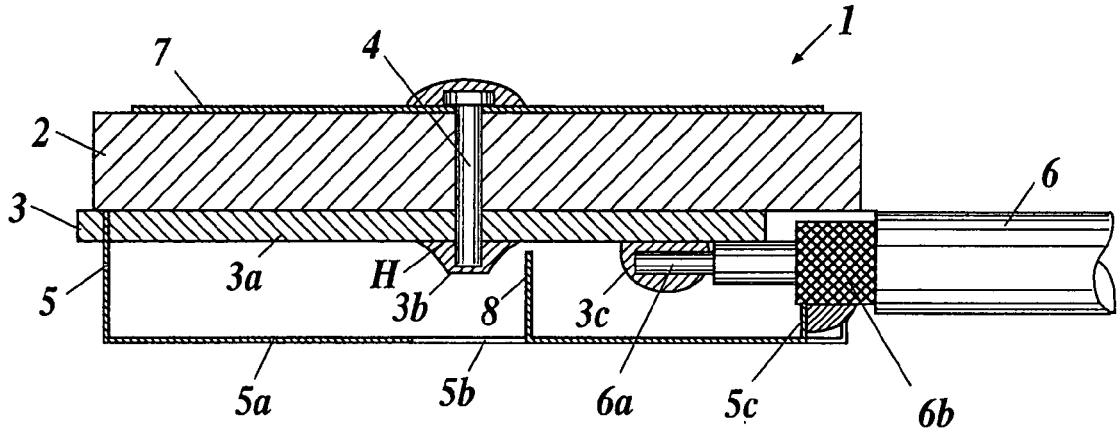
FIG. 3 is a schematic sectional view for illustrating a wall-like portion formed by bending the shield cover.
Figure 4:
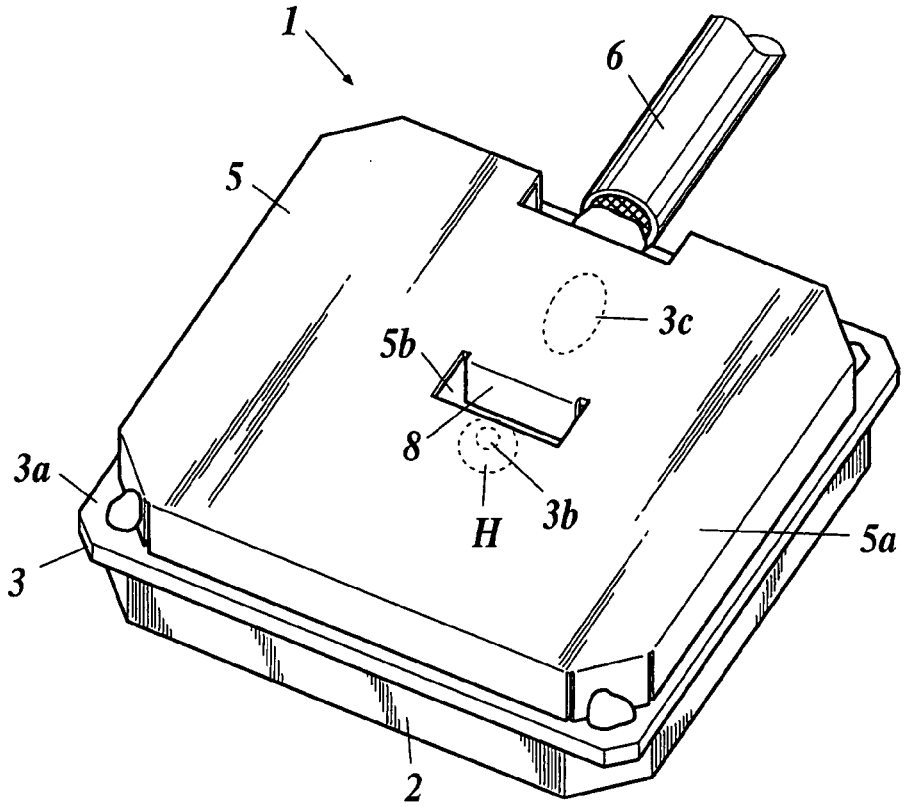
FIG. 4 is a perspective view showing the antenna apparatus of FIG. 3 being turned upside down.

Accordingly, as described in the present embodiment, the ascertainment aperture 5*b* can be configured as shown in FIGS. 3 and 4 when the ascertainment aperture 5*b* is formed in the shield cover 5. That is, for example, a part of the base surface 5*a* of the shield cover 5 which opposes to the input unit 3*b* is cut in a square shape with one side of the square left un-cut, and the cut portion is bent to the inner part of the shield cover 5. The bent part 8 is arranged like a wall at a position between the input unit 3*b* and the output unit 3*c* of the amplifier circuit.

By such configuration, the wall-shaped part 8 intercepts and absorbs the signals that leaks by transmitting through the air in the inner part of the shield cover 5 among the signals that leaked from the output unit 3*c*, and the wall-shaped part 8 makes the absorbed signals flow from the wall-shaped part 8 to the outer conductor 6*b* of the coaxial cable 6 through the shield cover 5. Consequently, at least the signals leaking through the air do not flow back to the input unit 3*b*, or is blocked from flowing back to the input unit 3*b*.

Consequently, the positive feedback to the input unit 3*b* of the circuit is obstructed or blocked, and the generation of the standing waves in the circuit is obstructed or reduced. Therefore, the generation of the abnormal oscillations caused by leakage of signals is prevented or suppressed to a degree that practically has no problem. In this manner, the deterioration of the isolation between the input signals and the output signals can be prevented, and it becomes possible to practically prevent the generation of the abnormal oscillations caused by leakage of signals.

Second Embodiment

Figure 5:
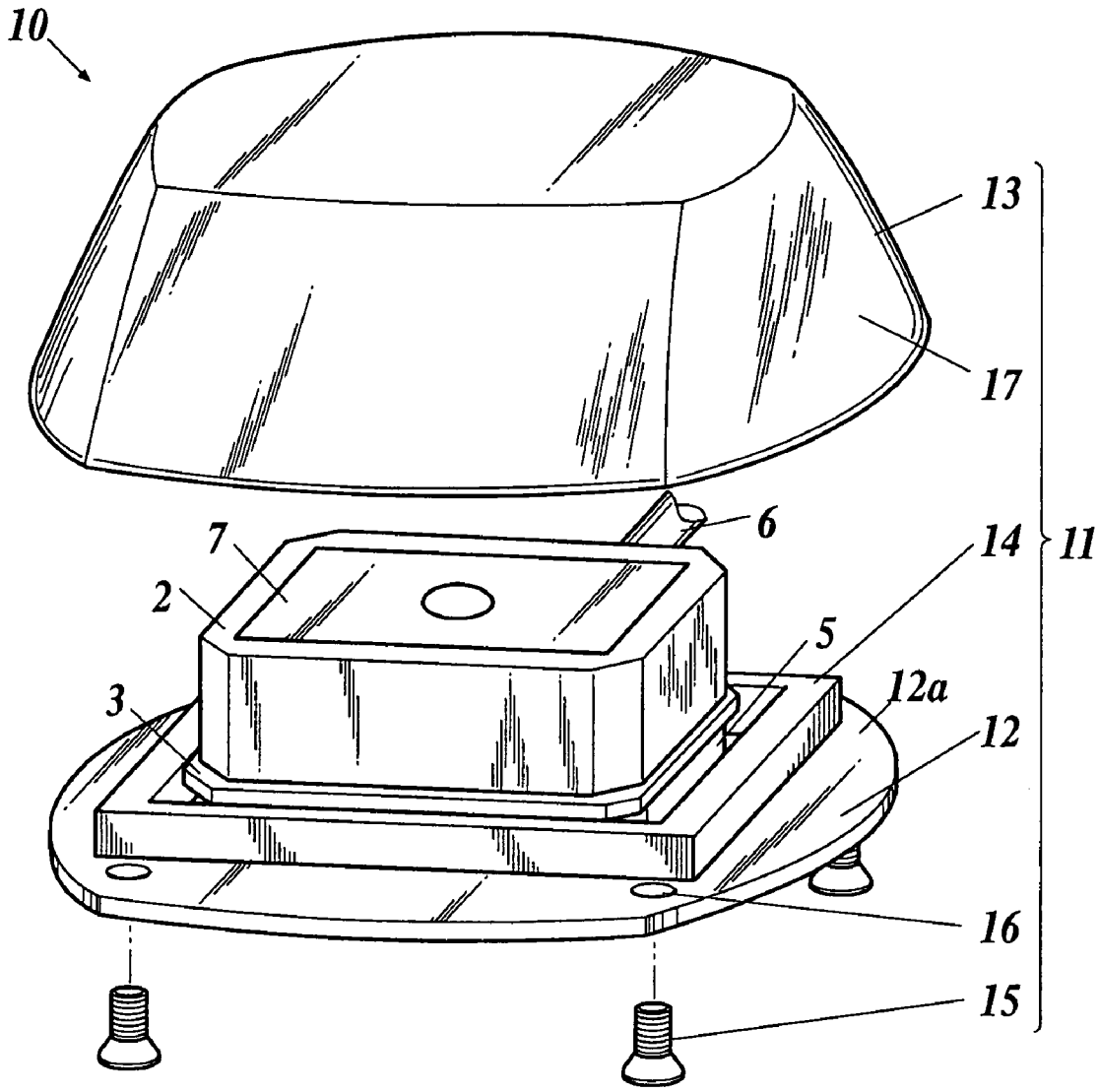
FIG. 5 is an exploded perspective view showing the configuration of an antenna apparatus according to a second embodiment.
Figure 6:
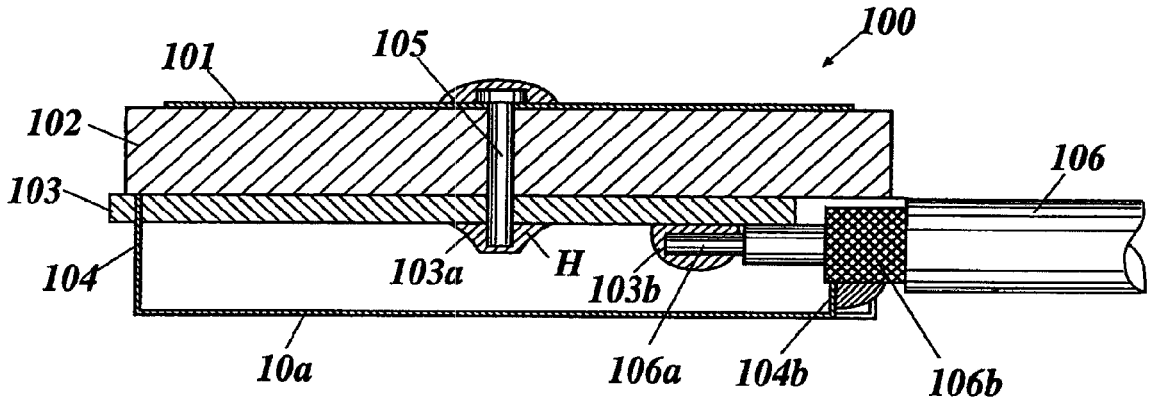
FIG.6 PRIOR ART
FIG. 6 is a schematic sectional view showing a configuration of a conventional antenna apparatus.
Figure 7:
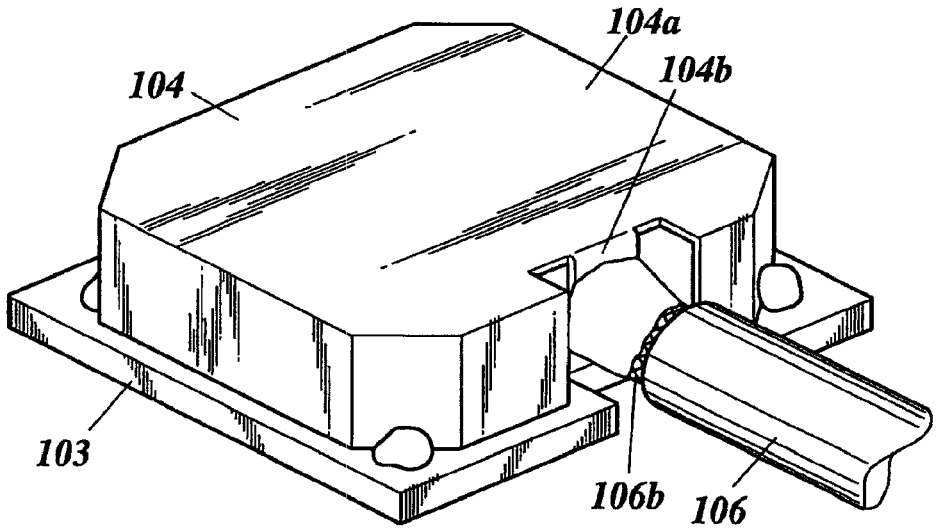
FIG.7 PRIOR ART
FIG. 7 is a perspective view of the antenna apparatus of FIG. 6 being turned upside down.

In a second embodiment, as shown in an exploded view of FIG. 5, a description is given for an antenna apparatus 10 configured such that the antenna apparatus 1 according to the first embodiment is built in an antenna case 11 composed of a bottom cover 12, a top cover 13, and the like.

In the following, the built-in antenna apparatus 1 according to the first embodiment is referred to as an antenna unit 1. Moreover, the configuration of the antenna unit 1 is the one described in the first embodiment, and the description thereof is omitted.

In the present embodiment, the bottom cover 12 of the antenna case 11 is formed of a substantially tabular metallic member such as iron, and constitutes the electroconductive member of the present invention. The antenna unit 1 is placed on the bottom cover 12 such that a side of the shield cover 5 of the antenna unit 1 is opposed to the bottom cover 12.

A packing member 14 formed of a resin material such as ethylene propylene rubber is attached on a surface 12*a* of the bottom cover 12 on the side where the antenna unit 1 is placed, so that the packing member 14 encloses the antenna unit 1. Moreover, through holes 16 to insert screws 15 for screwing the bottom cover 12 and the top cover 13 together are formed in the bottom cover 12. Here, the bottom cover 12 and the top cover 13 can be configured so as to be joined together by insertion for example, without using the screws 15.

The top cover 13 of the antenna case 11 is made of plastic or the like. In the following, a housing wall that house the antenna unit 1 therein and has a front edge abutting on the packing member 14 of the bottom cover 12, internal thread portions corresponding to the screws 15, and the like, though they are not shown, are integrally formed together with the outer wall 17 of the top cover 13 in the inner part of the outer wall 17. Moreover, a notch portion for passing through the coaxial cable 6 of the antenna unit 1 is formed in the outer wall 17, and a concave portion for enchasing the bottom cover 12 therein is formed at the end of the outer wall 17.

Here, the bottom cover 12 contacts with the base surface 5*a* of the shield cover 5, thus covering a portion of the base surface 5*a* which includes the ascertainment aperture 5*b*, from the outside. Moreover, in the present embodiment, the bottom cover 12 made of metal contacts the shield cover 5, and thus the grounding efficiency of the amplifier circuit and the antenna element 2 is further improved by the shield cover 5.

Next, the operation of antenna apparatus 10 according to the present embodiment is described.

The antenna unit 1 built in the antenna apparatus 10 functions as described in the first embodiment. Moreover, in a case where the antenna case 11 of the antenna apparatus 10 is disassembled, the soldering portion of the input pin 4 and the wiring of the circuit in the input unit 3*b* on the circuit board 3 can be observed through the ascertainment aperture 5*b* formed in the shield cover 5 of the antenna unit 1. Consequently, it is possible to ascertain by visual observation, whether the solder H for soldering in the input unit 3*b* exists or not, i.e., whether the soldering has been performed or not, or whether the soldering has been certainly performed or not.

Moreover, in the present embodiment, since the base surface 5*a* of the shield cover 5 contacts with the bottom cover 12 of the antenna case 11, the bottom cover 12 being made of metal and being provided in the bottom portion of the antenna unit 1, grounding efficiency of the shield cover 5 and grounding efficiency of the amplifier circuit and the antenna element 2 of the antenna unit 1 are improved.

Furthermore, the amplifier circuit of the antenna unit 1 is shielded from external disturbing waves by the shield cover 5 made of metal, and the portion of the ascertainment aperture 5*b* formed in the shield cover 5 is covered from the outside by the bottom cover 12 made of metal as described above. Therefore, even in a case where the ascertainment aperture 5*b* is formed, the shielding efficiency of the shield cover 5 from disturbing waves is maintained or improved.

As described above, according to the antenna apparatus 10 of the present embodiment, even in a case where the antenna unit 1 is built in the antenna case 11, the antenna unit 1 can be easily taken out by, for example, taking off the screws 15 of the antenna case 11, and the input unit 3*b* of the circuit can be easily observed through the ascertainment aperture 5*b* of the shield cover 5. Consequently, the same advantages as those of the antenna apparatus 1 according to the first embodiment can be obtained.

Moreover, as described above, there are cases where shielding efficiency of the shield covers 5 to shield disturbing waves becomes low due to providing the ascertainment apertures 5*b* in the shield covers 5, depending on the antenna unit 1. However, by surrounding the antenna unit 1 with the antenna case 11 so as to cover a portion of the shield cover 5 which includes at least the ascertainment aperture 5*b* with the electroconductive member, such as the bottom cover 12 made of metal described in the present embodiment, the part of the ascertainment aperture 5*b*, i.e., the defective part of the shield cover 5, can be blocked with the electroconductive member.

Consequently, even in a case where the ascertainment aperture 5*b* is formed in the shield cover 5, the shielding efficiency of the shield cover 5 to shield disturbing waves can be maintained.

Moreover, by forming the electroconductive member with the tabular metallic member as the bottom cover 12 of the present embodiment, formation of the electroconductive member becomes easy. By forming the whole surface of the base surface 5*a* of the shield cover 5 of the antenna unit 1 so as to be covered by, for example, the electroconductive member, the shielding efficiency of the shield cover 5 to shield disturbing waves can not only be maintained, but can also be improved.

Here, instead of forming the electroconductive member with the tabular metallic member as the bottom cover 12 of the present embodiment, the ascertainment aperture 5*b* of the shield cover 5 can be covered with a metallic tape such as a copper tape, which is detachable to the shield cover 5 as described in the modification of the first embodiment for example, or the metallic tape can be attached to a portion of the bottom cover 12 which corresponds to the ascertainment aperture 5*b* when the bottom cover 12 is formed of resin or the like. The shielding efficiency of the shield cover 5 to shield disturbing waves can be maintained as well by such measures.

Moreover, similar to the first embodiment, in a case where the shield cover 5 is configured so that a part of the shield cover 5 is bent to the inner part so as to be disposed like a wall at a position between the input unit 3*b* and the output unit 3*c* of the amplifier circuit, such configuration can obtain the same advantages as those of the first embodiment.

Here, although the descriptions given in the first and the second embodiments described the antenna apparatus 1 provided with the patch type receiving surface 7 that receives high frequency radio waves for the GPS or the satellite radio on the surface of the antenna element 2, the configuration of the antenna element 2 is not limited to the one provided with the patch type receiving surface 7.

As described, according to the embodiments of the present invention, there is provided an antenna apparatus, comprising:

an antenna element including a receiving unit to receive a radio wave;

a circuit board on which an amplifier circuit to amplify an input signal sent from the antenna element is formed;

an input pin to connect the receiving unit with the amplifier circuit; and a shield cover to cover the amplifier circuit on the circuit board, the shield cover shielding the amplifier circuit from a disturbing wave, wherein the input pin penetrates through the circuit board and is connected to the amplifier circuit by soldering, so as to structure an input unit of the circuit, and an ascertainment aperture is provided in the shield cover, the ascertainment aperture positioned such that the input unit can be observed from outside of the shield cover.

Since the ascertainment aperture is formed at the shield cover covering the surface of the circuit board, on which the circuit is formed, it becomes possible to easily and surely ascertain the existence of the solder and the quality of the soldering in the input unit of the circuit by visual observation through the ascertainment aperture even after the shield cover is attached to the circuit board.

Moreover, in a case where the antenna apparatus is configured as such, at the time of manufacturing the antenna apparatus, a worker at a manufacturing site can visually observe the soldering portion of the input pin and the wiring of the circuit, with respect to the input unit on the circuit board, through the ascertainment aperture formed in the shield cover. The observation can be conducted without removing the shield cover, and the worker can easily and surely ascertain the existence of the solder and the quality of the soldering in the input unit. Consequently, it is unnecessary to perform an ascertaining operation of soldering by removing the shield cover, re-attaching operation of the shield cover, and the like. Therefore, the manufacturing process is simplified, and it becomes possible to prevent the accuracy of the attachment of the shield cover from lowering, which is caused by the removal and the re-attachment of the shield cover.

Furthermore, in a case where the antenna apparatus undergoes breakdown during operation, a user can ascertain the existence of solder and the quality of soldering in the input unit by visual observation, in a similar manner through the ascertainment aperture without removing the shield cover. Consequently, the user can be prevented from judging that the trouble is caused by failure of the soldering in the input unit and from removing the shield cover from the circuit board, although the soldering in the input unit is adequate.

Preferably, the ascertainment aperture is provided in the shield cover such that a position of the ascertainment aperture opposes to the input unit.

Since the ascertainment aperture is provided in the shield cover, the ascertainment aperture being positioned so as to oppose to the input unit, ascertainment of the existence of solder and the quality of soldering in the input unit can be conducted easier and more certainly by visual observation through the ascertainment aperture, and the advantages of the present embodiment can be more precisely realized.

Preferably, at least a portion of the shield cover including the ascertainment aperture is covered with an electroconductive member.

Accordingly, in a case where the shielding efficiency of the shield cover to shield disturbing waves is lowered due to the provision of the ascertainment aperture, the portion including the ascertainment aperture of the shield cover can be obstructed by covering the part with the electroconductive member, such as a metallic plate and a metallic tape, and thus the shielding efficiency can be prevented from lowering and the shielding efficiency can be kept high, in addition to the advantages of the present embodiment.

Preferably, the electroconductive member is a tabular metallic member.

Since the ascertainment aperture of the shield cover is obstructed by covering the ascertainment aperture with the tabular metallic member, the shielding efficiency of the shield cover to shield disturbing waves can be prevented from lowering, and thus the shielding efficiency can be maintained, enabling the realization of the advantage of the present embodiment. At the same time, it becomes possible make the metallic member contact with the shield cover to improve the grounding efficiencies of the amplifier circuit and the antenna element through the shield cover.

Preferably, the electroconductive member is a metallic tape.

Accordingly, the advantage of the present embodiment can be easily realized only by attaching to the shield cover the metallic tape or a cover made of a resin, which cover the ascertainment aperture of the shield cover.

Preferably, the ascertainment aperture is formed by bending a portion of the shield cover to an inner side of the shield cover, and the bent portion is disposed as a wall in a position between the input unit and an output unit of the amplifier circuit, the output unit outputting a signal amplified by the amplifier circuit.

Accordingly, concerning the deterioration of the isolation of inputs and outputs of signals due to the miniaturization of the apparatus and the like, since the wall is provided between the input unit 3*b* and the output unit 3*c* of the amplifier circuit, the positive feedback from the output unit 3*c* to the input unit 3*b* of the circuit is obstructed or blocked, thereby obstructing or reducing the generation of standing waves in the circuit. Therefore, the generation of abnormal oscillations caused by leakages of signals can be prevented or be suppressed to a degree in which no problem occurs. Consequently, the deterioration of the isolation of the inputs and the outputs of signals can be effectively prevented, and the abnormal oscillations caused by the leakages of signals can be practically prevented in addition to the advantages of the present invention.

The entire disclosure of Japanese Patent Application No. 2006-252292 filed on Sep. 19, 2006 including specification, claims, drawings and abstract are incorporated herein by reference in its entirety.

Although various exemplary embodiments have been shown and described, the invention is not limited to the embodiments shown. Therefore, the scope of the invention is intended to e limited solely by the scope of the claims that follow.

What is claimed is:

1. An antenna apparatus, comprising:

an antenna element including a receiving unit to receive a radio wave;

a circuit board on which an amplifier circuit to amplify an input signal sent from the antenna element is formed;

an input pin to connect the receiving unit with the amplifier circuit; and a shield cover to cover the amplifier circuit on the circuit board, the shield cover shielding the amplifier circuit from a disturbing wave, wherein the input pin penetrates through the circuit board and is connected to the amplifier circuit by soldering, so as to structure an input unit of the amplifier circuit, wherein an ascertainment aperture is provided in the shield cover, the ascertainment aperture being positioned such that the input unit can be observed from outside of the shield cover, wherein the ascertainment aperture is formed by bending a portion of the shield cover to an inner side of the shield cover, and wherein the bent portion is disposed as a wall in a position between the input unit and an output unit of the amplifier circuit, wherein the output unit outputs a signal amplified by the amplifier circuit.

2. The antenna apparatus according to claim 1, wherein the ascertainment aperture is provided in the shield cover such that a position of the ascertainment aperture opposes the input unit.

3. The antenna apparatus according to claim 1, wherein at least a portion of the shield cover including the ascertainment aperture is covered with an electroconductive member.

4. The antenna apparatus according to claim 3, wherein the electroconductive member comprises a tabular metallic member.

5. The antenna apparatus according to claim 3, wherein the electroconductive member comprises a metallic tape.

* * * * *